United States Patent [19]

Durai-Swamy

[11] 4,359,363

[45] Nov. 16, 1982

[54] APPARATUS FOR ENTRAINED COAL PYROLYSIS

[75] Inventor: Kandaswamy Durai-Swamy, Culver City, Calif.

[73] Assignee: Occidental Research Corporation, Irvine, Calif.

[21] Appl. No.: 298,566

[22] Filed: Sep. 2, 1981

[51] Int. Cl.[3] ..... C10B 1/04; C10B 3/00; C10B 49/20

[52] U.S. Cl. ..... 202/99; 201/22; 201/31; 202/108; 202/215

[58] Field of Search ..... 202/99, 108, 117, 121, 202/215; 201/12, 22, 31; 208/8 R

[56] References Cited

U.S. PATENT DOCUMENTS

| | | | |
|---|---|---|---|
| 2,700,644 | 1/1955 | Leffer | 201/31 |
| 4,064,018 | 12/1977 | Choi | 201/12 |
| 4,085,030 | 4/1978 | Green et al. | 201/12 |
| 4,102,773 | 7/1978 | Green et al. | 201/12 |
| 4,141,794 | 2/1979 | Choi | 201/12 |
| 4,145,274 | 3/1979 | Green et al. | 201/12 |
| 4,162,943 | 7/1979 | Green | 201/12 |
| 4,163,693 | 8/1979 | Green | 201/22 |
| 4,280,876 | 7/1981 | Green | 201/12 |
| 4,280,877 | 7/1981 | Thomas et al. | 202/117 |

*Primary Examiner*—Bradley Garris
*Attorney, Agent, or Firm*—Forrest E. Logan

[57] ABSTRACT

This invention discloses a process and apparatus for pyrolyzing particulate coal by heating with a particulate solid heating media in a transport reactor. The invention tends to dampen fluctuations in the flow of heating media upstream of the pyrolysis zone, and by so doing forms a substantially continuous and substantially uniform annular column of heating media flowing downwardly along the inside diameter of the reactor. The invention is particularly useful for bituminous or agglomerative type coals.

2 Claims, 4 Drawing Figures

APPARATUS FOR ENTRAINED COAL PYROLYSIS

The Government has rights in or in respect of this invention pursuant to Contract No. E (49-18)-2244 awarded by the U.S. Energy Research and Development Administration.

BACKGROUND OF THE INVENTION

Fluid fossil fuels such as oil and natural gas are becoming scarce as a result of the increased world population and the increased uses for such fuels. Furthermore, since there is reason to believe that the steady importation of fluid fossil fuels into the United States could be disrupted from time to time, there is a need for a method for converting coal into liquid and gaseous fuels.

Heretofore, pyrolysis processes employing particulate solid heating media and transport reactors have had a serious problem maintaining a steady and uniform flow of particulate solid heating media into the reactor zone. Upsets and disturbances to the flow of heating media frequently occur in such systems which result in a drop in yield of pyrolysis vaporous product and, in some cases, the formation of plugs in the transport reactor or elsewhere in the system. In addition, such upsets usually result in inefficient separation of the char product from the condensable vaporous product. This in turn results in ultimate contamination of the liquid product with char product. To remove such char from the liquid product requires expensive and time-consuming separation steps which become very costly and can cause the process to be uneconomical.

The present invention is an improvement in the state of art of pyrolysis because it reduces the tendency for such upsets and disturbances to cause non-uniform and non-continuous flow of particulate solid heating media into the pyrolysis zone. The present invention, therefore, has as an objective—that of providing a substantially uniform and continuous flow of particulate solid heating media into the pyrolysis zone when upstream upsets and disturbances in the flow of particulate solid heating media occur. The present invention also has as objectives improving the yield of recoverable liquid product, reducing the formation of plugs in the reactor and downstream equipment therefrom, and reducing or eliminating the need for separation of char product from liquid product.

SUMMARY OF THE INVENTION

The present invention is an improved method for controlling the flow of solid heating media into a pyrolysis reactor. In general, a particulate solid heating media, which has been heated to an elevated temperature, is introduced into a fluidization zone and fluidized with a fluidizing gas. A part of the heating media is aerated with a lift gas in such a manner that the heating media is caused to flow upwardly in a column in a riser zone which surrounds the outside and upper part of a vertically oriented conduit reactor. The upper part of the conduit reactor constitutes the reactor's inlet. The upwardly flowing column of the heating media thusly formed in the riser zone is deflected in such a manner that the heating media is turned around at the reactor inlet from an upwardly flowing column to a downwardly flowing uniform and continuous column which is made to flow along the inside surface of the reactor.

The present invention is useful for a continuous process for the recovery of a vaporous product and a particulate coal char from coal, and is especially effective for bituminous or agglomerative coals. In the present process, a particulate feed stream containing coal particles of a size less than about 1000 microns in diameter, and less than about 250 microns in diameter in the case of bituminous coals, is introduced downwardly, centrally and in turbulent flow into a pyrolysis zone contained in a conduit reactor. A transport gas for effecting turbulent flow is employed which is substantially non-deleteriously reactive with respect to the coal and the vaporous product and particulate coal char product produced from the coal. In general, the pyrolysis zone is operated at a temperature above about 700° F. In one embodiment the coal is heated to a temperature between about 700° and about 1900° F. by transfer of heat from a particulate solid heating media. In one embodiment the particulate solid heating media has a particle size less than about 2000 microns in diameter, and preferably is produced from the particulate coal char product. In general, the particulate solid heating media is introduced into the pyrolysis zone at a temperature above the pyrolysis temperature so that heat is transferred from the heating media to the particulate coal. In general, the heating media is fluidized with a fluidizing gas in a fluidization zone which surrounds an annular riser zone. The particulate solid heating media is caused to flow from the fluidization zone to the annular riser zone by aeration with a lift gas in such a way as to form an upwardly flowing annular column which is contained in the annular riser zone. This can be accomplished by the particular design of the pyrolysis reactor of the present invention. The annular riser zone is located around the outside diameter and upper part of the vertically-oriented conduit reactor. The aerated heating media flowing upwardly in an annular column form is deflected at a point slightly above the plane of the inlet to the conduit reactor by a deflecting means which causes the upwardly flowing annular column to be deflected and converted into a downwardly flowing annular column which then flows along the inside diameter of the conduit reactor and into a pyrolysis zone within that reactor. The turbulent stream of particulate coal and the transport gas are then introduced downwardly and centrally into the pyrolysis reactor along its axis under flow conditions sufficient to cause the coal and the heating media to be thoroughly mixed. Heat is transferred from the heating media to the coal, thereby causing the coal to be pyrolyzed and a vaporous product and a particulate coal char produced therefrom.

In general, the fluidizing gas and the lift gas, which in combination cause the particulate solid heating media to flow into the conduit reactor, are both substantially non-deleteriously reactive with respect to the coal, the vaporous product and the particulate coal char product.

In one embodiment of the present invention, the particulate solid heating media has a temperature between about 800° and about 2000° F., and the ratio of the heating media to the coal introduced into the pyrolysis zone is between about 2 parts by weight heating media per part by weight coal to about 20 parts by weight heating media per part coal, i.e. about 2/1 to about 20/1.

The pyrolysis reactor of the present invention in which the above-described process can be conducted, comprises a conduit reactor which has an inlet and an outlet and a circular cross-section of constant inside diameter over a predetermined length. The axis of the conduit reactor is vertically oriented and the plane of the inlet is perpendicular to the axis. A first feed conduit, which is operative for conveying a mixture of a transport gas and particulate coal in turbulent flow, is provided which has an inlet and an outlet and a circular cross-section. The axis of the first feed conduit is made to coincide with the reactor axis, and the plane of the first feed conduit outlet is perpendicular to its axis. The first feed conduit outlet is in communication with the reactor inlet in such a way that the plane of the first feed conduit outlet is not above the plane of the reactor inlet. In general, the reactor inside diameter is at least 3 times the outside diameter of the first feed conduit outlet or at least about 3 times the outside diameter of the heat shield on the first feed conduit if such is used, at the reactor outlet. Thus, in the present invention, an annular opening is formed between the inside diameter of the reactor and the outside diameter of the first feed conduit. It is through this annular opening that particulate solid heating media is introduced into the conduit reactor.

A fluidization chamber, operative for fluidizing a mixture of particulate solid heating media and a fluidizing gas, is provided which is in communication with the reactor inlet. In one embodiment, the fluidization chamber comprises a cylindrical outer shell having an inside diameter which is at least about 2 times the outside diameter of the reactor and which has an axis which coincides with the conduit reactor axis. It is not necessary that the fluidization chamber axis be concentric with the reactor axis in all embodiments as will be further described below. A top cover is provided which is above the plane of the reactor inlet and which is fastened to the upper part of the cylindrical outer shell in such a manner that the first feed conduit passes through the top cover and is fastened to the top cover. A bottom cover is provided which is below the plane of the reactor inlet and which is fastened to the lower part of the cylindrical outer shell. The conduit reactor passes through the bottom cover and is fastened to the bottom cover. In one embodiment, an aeration partition means is provided which is spaced above the bottom cover, but below the plane of the reactor inlet. This means is operative for permitting the fluidizing gas to flow through the aeration partition means so that particulate solid heating media in the fluidization chamber can be substantially uniformly fluidized therein. A first aeration means having an outlet which is in communication with the fluidization chamber is provided which is located below the aeration partition means. The first aeration means is operative for introducing the fluidizing gas into the fluidization chamber under the aeration partition means.

Alternately, in place of the aeration partition means, a pipe distributor means having a plurality of gas outlets can be used for fluidization of the particulate material in the fluidization chamber. Such pipe distributor means can be arranged in a circular configuration, and if a large area of fluidization is required several concentric pipe distributor means can be used. Arrangements other than concentric circles can be used if desired for the pipe distributor means. In general, any fluidization means operable for fluidizing the particular material in the fluidization chamber can be used.

When the pyrolysis reactor is in use, the fluidizing gas is discharged from the outlet of the first aeration means and is uniformly distributed through the aeration partition means to fluidize the particulate solid heating media in the fluidized bed above the aeration partition means. A second feed conduit is provided which is operative for introducing a stream of particulate solid heating media into the fluidization chamber. The second feed conduit is radially displaced from the conduit reactor and has an outlet which is below the plane of the conduit reactor inlet but above the aeration partition means. An annular baffle means is provided which has an axis which coincides with the axis of the conduit reactor. The baffle means comprises a side wall and a deflector. The side wall has an inside diameter which is somewhat greater than the reactor outside diameter. The side wall extends above and below the plane of the conduit reactor inlet and is spaced somewhat above the aeration partition means. The side wall and the conduit reactor, in combination, form an annular riser. The deflector, which is attached to the top of the side wall, is spaced somewhat above the plane of the reactor inlet and extends from the side wall to a point slightly radially inwardly of the conduit reactor inside diameter. A second aeration means is provided which has a plurality of outlets which are located radially inwardly of the side wall, and radially outwardly of the reactor outside diameter. The second aeration means is operative for introducing a lift gas upwardly into the annular riser. The baffle means and the second aeration means in combination being operative, when the present apparatus is in use, to cause the particulate solid heating media which has been fluidized in the fluidization chamber to flow under the side wall of the annular baffle means, then to flow upwardly in the annular riser, then to be deflected downwardly at the top of the annular riser by the deflector part of the baffle means, and lastly to be formed into a substantially continuous and substantially uniform annular column of heating media flowing downwardly along the conduit reactor inside diameter. In general, the second aeration means can be any means which is operative for introducing a lift gas upwardly into the annular riser in such a manner as to cause the particulate solid heating media to flow upwardly in the annular riser zone as described herein.

Returning to the first aeration means, such means can be of similar configuration as the second aeration means if desired, i.e. an annular pipe distributor means.

In one embodiment, the apparatus of the present invention has a reactor inside diameter which is from about 3 to about 30 times the outside diameter of the first feed conduit at its outlet. In one embodiment of this invention, the side wall inside diameter of the annular baffle means is from about 1.01 to about 1.25 times the reactor outside diameter.

In one embodiment of the present invention, the process of the present invention is conducted in the apparatus of the present invention. However, it is to be understood that it is not necessary that the process of the present invention be conducted in the apparatus of the present invention.

In the present process, a stream comprising the vaporous product, the particulate coal char product, the particulate solid heating media, the fluidizing gas, the lift gas, and the transport gas, is removed from the pyrolysis zone through the conduit reactor outlet. This mixture is then passed to a first separation zone, such as one or more cyclone separators, to separate at least the bulk of the solids from the gases and vapors contained in the stream discharged from the conduit reactor outlet.

DRAWINGS

DETAILED DESCRIPTION

Figure 1:
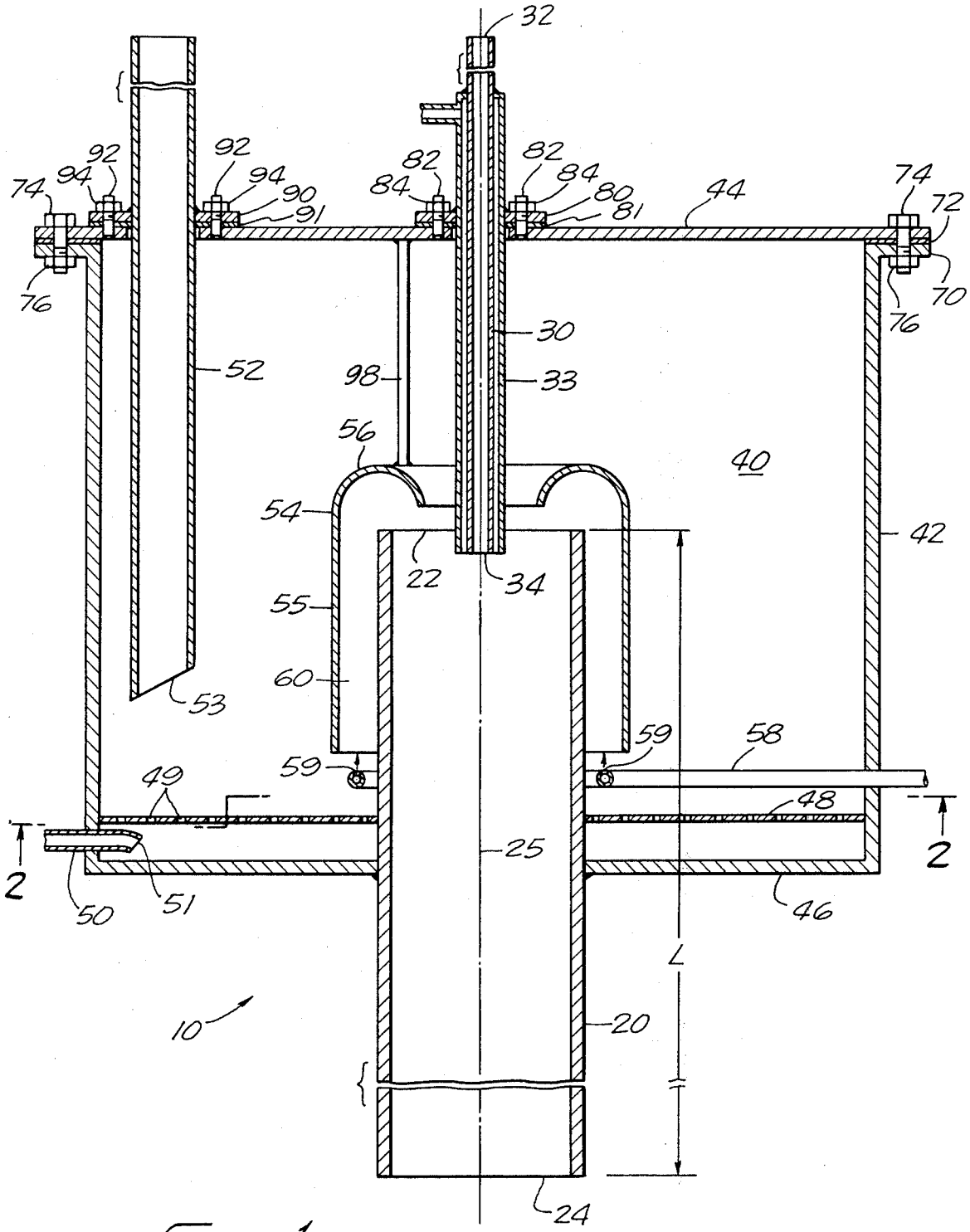
FIG. 1 is a drawing of one embodiment of a pyrolysis reactor.

With reference to FIG. 1, according to the present invention there is provided a pyrolysis reactor 10 which is operative for pyrolyzing coals. The pyrolysis reactor comprises conduit reactor 20 having an inlet 22 and outlet 24. Conduit reactor 20 has a circular cross-section of constant inside diameter over predetermined length L. Axis 25 of reactor 20 is vertically oriented, and the plane of inlet 22 is perpendicular to axis 25. First feed conduit 30, which is operative for conveying a mixture of a transport gas and particulate coal in turbulent flow, has inlet 32 and outlet 34, and has a circular cross-section and an axis which coincides with reactor axis 25. In the preferred embodiment shown in FIG. 1, first feed conduit 30 also comprises an annular heat shield 33 which is concentric to first feed conduit 30 and extends from first feed conduit outlet 34 upwards through the top cover of the fluidization chamber as will be described in greater detail below. The plane of first feed conduit outlet 34 is perpendicular to axis 25 and is in communication with reactor inlet 22 in such a way that the plane of first feed conduit outlet 34 is not above the plane of reactor inlet 22. As shown in the particular embodiment of FIG. 1, the plane of outlet 34 is below the plane of inlet 22 so that outlet 34 actually extends into reactor 20. The inside diameter of reactor 20 is at least about 3 times the outside diameter of first feed conduit 30 at outlet 34 thereby providing an opening which is at least about 90 percent of the cross-sectional area conduit 20 based on its inside diameter. In the preferred embodiment of FIG. 1, wherein first feed conduit 30 also comprises annular heat shield 33, the inside diameter of reactor 20 is in general at least about 3 times the outside diameter of annular heat shield 33.

Fluidization chamber 40, which is operative for fluidizing a mixture of particulate solid feeding media, comprises cylindrical outer shell 42, top cover 44, bottom cover 46, aeration partition means 48, first aeration means 50, second feed conduit 52, annular baffle means 54, and second aeration means 58. Cylindrical outer shell 42 has an inside diameter which is at least 2 times the outside diameter of reactor 20, and the axis of cylindrical outer shell 42 coincides with the reactor axis thereby providing an operative bed configuration to effect uniform fluidization. Top cover 44 is spaced above the plane of reactor inlet 22 and is fastened to cylindrical outer shell 42. First feed conduit 30, which comprises annular heat shield 33, passes through and is fastened to top cover 44. Bottom cover 46 is located below the plane of reactor inlet 22 and is fastened to the lower part of cylindrical outer shell 42. Reactor 20 passes through and is fastened to bottom cover 46. Aeration partition means 48 is spaced above bottom cover 46, but below the plane of reactor inlet 22. First aeration means 50 has an outlet 51 which is located below aeration partition means 48. Alternative to aeration partition means 48 and first aeration means 50, any fluidization means operative for fluidizing the solid particulate heating media in the fluidization chamber can be used.

Second feed conduit 52 has an outlet 53 which is spaced below the plane of reactor inlet 22, but above aeration partition means 48. Second feed conduit 52 is radially displaced from reactor 20. Annular baffle means 54 comprises a side wall 55 and a deflector 56. Side wall 55 has an inside diameter which is somewhat greater than the outside diameter of reactor 20. Side wall 55 extends above and below the plane of reactor inlet 22, but is spaced above aeration partition means 48. Annular baffle means 54 has an axis which coincides with reactor axis 25. Side wall 55 and reactor 20 in combination form annular riser 60. Deflector 56 is above the plane of reactor inlet 22, and extends from side wall 55 to a point slightly radially inwardly of the inside diameter of reactor 20. Second aeration means 58, having a plurality of outlets 59, is located radially inwardly of side wall 55 and radially outwardly of outside diameter of reactor 20. Outlets 59 of second aeration means 58 are spaced entirely above aeration partition means 48.

As can be seen in FIG. 1, conduit reactor 20, first feed conduit 30, and annular baffle means 54, all have a common axis, i.e. axis 25. In the embodiment of FIG. 1, fluidization chamber 40 which comprises cylindrical outer shell 44 also has an axis, axis 25. It is not necessary in all embodiments of this invention that the fluidization chamber have a common axis with reactor 20, however, which will be apparent for reasons described below.

As shown in FIG. 1, the elements of pyrolysis reactor 10 are fastened together by means of nuts and bolts or welds. For example, top cover 44 is fastened to cylindrical outer shell 42 by the conventional means of a flange 70, gasket 72, bolt 74, and nut 76. First feed conduit 30, which comprises annular heat shield 33, is similarly fastened to top cover 44 by means of flange 80 which is welded to conduit 30 and studs 82 which are welded to top cover 44 and nuts 84 and gasket 81. Similarly, second feed conduit 52 is fastened to top cover 44 by means of flange 90 which is welded to conduit 52, gasket 91, studs 92 which are welded to top cover 44, and nuts 94. Although the various elements of pyrolysis reactor 10 have been shown to be fastened together in FIG. 1 by conventional means such as flanges, gaskets, nuts and bolts and welds, any suitable means of fastening may be employed. The particular arrangement of joining the various elements together shown in FIG. 1 is an embodiment of this invention which is particularly useful since it facilitates disassembly and inspection of the pyrolysis reactor from time to time. Other arrangements of arranging the various elements together can be devised by those skilled in the art. For example, bottom cover 46 and cylindrical outer shell 42 can be fastened together in a manner similar to top cover 44 and shell 42, and reactor 20 can be fastened to bottom cover 46 in the same manner that conduit 30 is fastened to top cover 44. Annular baffle means 54 is secured in its proper position by means of several struts 98 which are welded to top cover 44 and deflector 56 of annular baffle means 54. Other means of support for annular baffle means 54 can be provided, such as supporting by means of struts attached to cylindrical outer shell 42 or struts attached to conduit reactor 20.

As shown in FIG. 1, reactor inlet 22 actually consists of an annular opening formed by the outside diameter of annular heat shield 33 and the inside diameter of conduit reactor 20 in such a manner that at least about 90 percent of the inlet area of reactor 20 is open.

Figure 2:
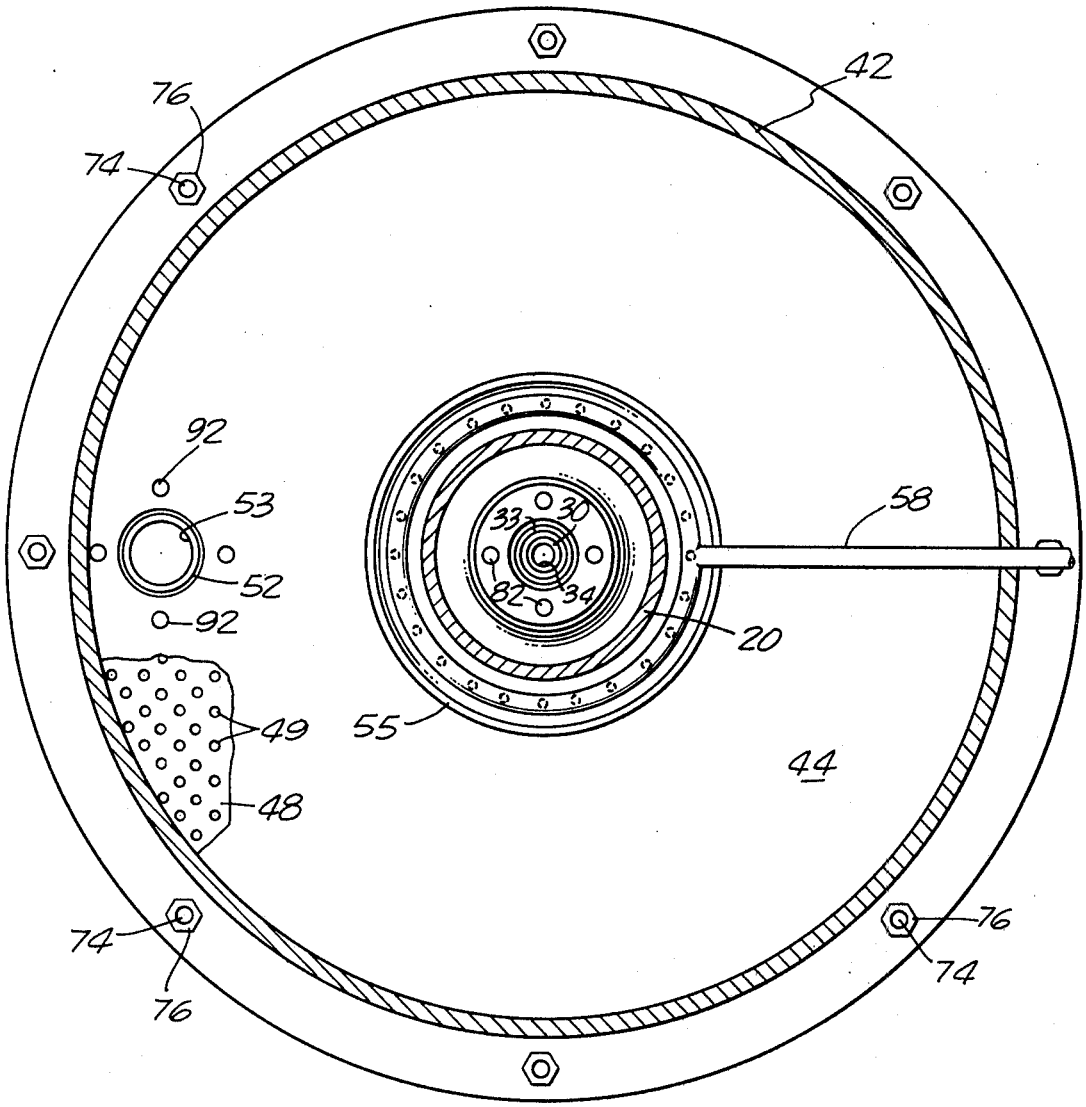
FIG. 2 is a view through FIG. 1 taken along line 2 of FIG. 1.

FIG. 2 is a view of FIG. 1 taken along the line 2—2 of FIG. 1. In this particular embodiment of the present invention, aeration partition means 48 is a perforated plate having a plurality of openings 49 through which a fluidizing gas flows. Aeration partition means can be a screen or another design suitable for effecting fluidization. For example, aeration partition means 48 and first aeration means 50 can be replaced with any fluidization means operative for fluidizing the solid particulate heating media in the fluidization chamber.

Figure 3:
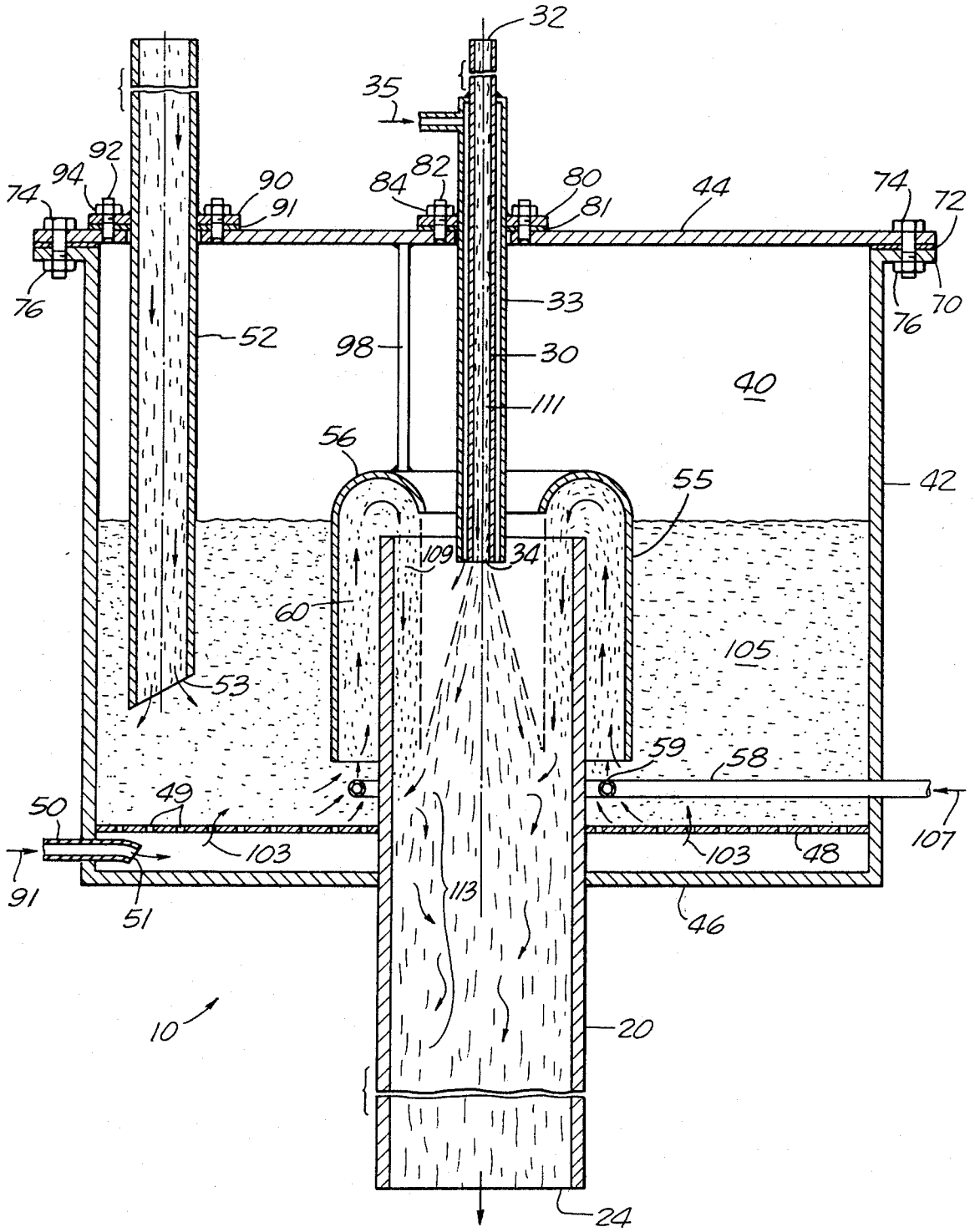
FIG. 3 is a drawing showing the pyrolysis reactor of FIG. 1, when in use, showing flow of solid materials.

FIG. 3 depicts pyrolysis reactor 10 when it is employed for pyrolyzing coal by the present invention. In the present invention particulate solid heating media, such as heated particulate coal char, is introduced through conduit 52 into fluidization chamber 40, together with fluidization gas introduced through first aeration means 50. The fluidizing gas flows upwardly through opening 49 in aeration partition means 48, as shown by arrows 103, in such a way that the particulate solid heating media is maintained in a fluidized state as shown by fluidized bed 105. The heating media is aerated with a lift gas 107 introduced through second aeration means 58. The lift gas flows upwardly in annular riser 60 in such a way that the heating media which is fluidized in the fluidization chamber is caused to flow under side wall 55, to flow upwardly in annular riser 60, then to be deflected downwardly at the top of annular riser 60 by deflector 56, and then to be formed into a substantially continuous and substantially uniform annular column of heating media along the inside diameter of reactor 20, as shown in FIG. 3 by annular column of heating material 109.

A turbulent mixture 111 of particulate coal and a transport gas is conveyed in conduit 30 and introduced downwardly and centrally into reactor 20 along the axis 25. In order to prevent the coal in conduit 30 from being heated an undesirable amount prior to its discharge into the pyrolysis zone, a small amount of gas is fed through the annular space between the heat shield 33 and conduit 30. This heat shield gas is also introduced downwardly into the reactor. The heat shield gas should also be substantially non-deleteriously reactive with respect to the coal, the vaporous product and the particular coal char product. The coal and heating media are rapidly mixed in pyrolysis zone 113 which is contained in reactor 20. The coal is pyrolyzed in pyrolysis zone 113 by the rapid transfer of heat from the heating media to the coal and a vaporous product and a particulate coal char product is produced directly from the coal. The temperature to which the coal is heated is controlled by adjusting the relative amounts of the heating media entering through conduit 52 and the amount of coal entering through conduit 30, as well as by adjusting the temperature of the heating media before it is introduced into fluidized bed 105. A stream from the pyrolysis zone which comprises the vaporous product, the particulate coal char product, the heating media, and the fluidizing, lift and transport gases, and heat shield gas if employed, is removed from the pyrolysis zone through reactor outlet 24.

The process and apparatus of the present invention are particularly useful for bituminous or agglomerative coals because downwardly flowing annular column 109 of heating media forms a shield along the inside surface of reactor 20 which prevents the coal when it is in its tacky state from adhering to the inside surface of reactor 20 which, if it were to so adhere, would eventually plug reactor 20. The heat shield and heat shield gas are particularly useful when pyrolyzing bituminous or agglomerative coal since they prevent premature agglomeration of the coal in conduit 30 by preventing the coal from reaching agglomerative temperatures in conduit 30. However, for non-agglomerative coals such as subbituminous coal, heat shield 33 and a heat shield gas are not required.

Figure 4:
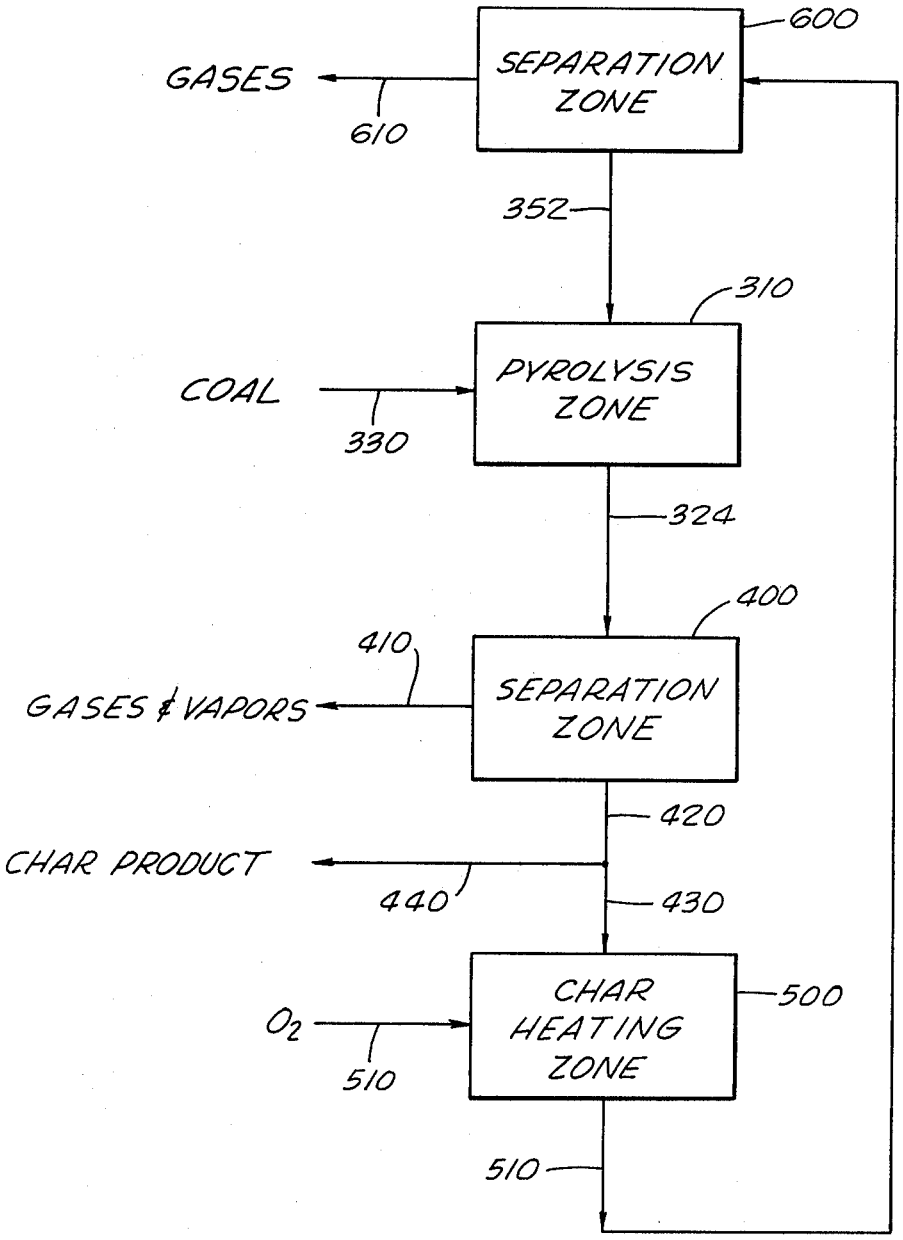
FIG. 4 is a schematic diagram of a pyrolysis process suitable for use with the apparatus or process of the present invention.

With reference to FIG. 4, particulate coal in stream 330 is introduced into pyrolysis zone 310, together with heated particulate coal char in stream 352. About 2 parts by weight of heated coal char per part by weight of coal, to about 20 parts by weight of heated coal char per part by weight of coal are introduced into pyrolysis zone 310. The temperature of heated coal char stream 352 is from about 800° to about 2000° F. Pyrolysis zone 310 is maintained at a temperature between about 700° and about 1900° F. by adjusting the temperature of the heated coal char in stream 352 and the ratio of heated coal char to coal fed to pyrolysis zone 310. In general pyrolysis zone 310 is maintained under the conditions described above. In one embodiment of the process, pyrolysis is conducted in the pyrolysis reactor of FIG. 1.

In another embodiment of this invention, fluidization chamber 40 can be made to accommodate a plurality of reactors similar to reactor 20. Each reactor comprising its own annular baffle means and feed conduit. In such a system a plurality of char feed conduits, similar to conduit 52 can be provided. In this manner a single fluidization chamber can serve a plurality of coal pyrolysis reactors, thereby facilitating scale up to larger pyrolysis systems. In such configurations the fluidization chamber cannot be concentric to all reactors.

The products of pyrolysis which comprise gases and vapors, as well as a newly formed coal char product, are removed from pyrolysis zone 310 by means of stream 324 which is then introduced into separation zone 400 wherein gases and vapors which comprise vapors produced directly from the coal are removed in stream 410. Separated solids, which comprise the spent heated char and the newly formed char product, are removed in stream 420 from separation zone 400. Separation zone 400 may be a series of cyclone separators or the like. An amount of these solids which are necessary for recycle to the pyrolysis zone is divided from stream 420 into stream 430, and the remainder is removed as char product in stream 440. Stream 430 of char solids is introduced into char heating zone 500 where it is partially combusted and heated with a gas comprising oxygen, such as air, or oxygen-enriched air, or a commercial grade gaseous oxygen, introduced through stream 510. The amount of oxygen in the oxygen-containing gas of stream 510 is between about 0.01 parts by weight per part by weight coal char and about 0.10 parts by weight per part by weight coal char. The char solids are heated in char heating zone 500, which preferably is a transfer line combustor, fluidized bed combustor or the like, to a predetermined temperature operable for recycle to and use in pyrolysis zone 310 as the heat supplying heated char. Heated char is removed from char heating zone 500 in stream 510 and introduced into separation zone 600, which may be a series of cyclone separators or the like, wherein the combustion gases are separated and removed in stream 610 and the heated char is removed and recycled to pyrolysis zone 310 in stream 352.

Stream 352 is the feed stream introduced into the inlet of second feed conduit 52 of FIG. 1. Similarly, coal stream 330 is the feed stream introduced into inlet 32 of first feed conduit 30 of FIG. 1. Product removal stream 324 corresponds to the discharge stream from outlet 24 of conduit reactor 20 of FIG. 2.

EXAMPLE

A pyrolysis reactor of the general configuration depicted in FIG. 1 is used for the pyrolysis of coal wherein conduit reactor 20 has an inside diameter of about 10 inches, side wall 55 has an inside diameter of about 11 to 11.5 inches, outer cylindrical shell 42 has an inside diameter of about 20 inches, annular heat shield 33 has an outside diameter of about 1.1 inch at outlet 34, second feed conduit 52 has an outside diameter of about 2 inches, aeration partition means 48 is spaced about 1 inch above bottom cover 46, the lower extremity of side wall 55 is spaced about 2 inches above aeration partition means 48, the uppermost portion of deflector 56 is spaced about 1 inch above the plane of inlet 22, the plane of outlet 34 is spaced about 2 inches below the plane of inlet 22, and outlet 53 is spaced about 10 inches below the plane of inlet 22. The length of reactor 20, over which reactor 20 has a constant diameter, and in which the pyrolysis zone is contained, is about 36 to about 60 inches.

About 1500 pounds per hour of heated particulate coal char is introduced into fluidization zone 40 through second feed conduit 52 wherein it is fluidized with a fluidized gas which consists of a mixture of steam, carbon dioxide, or mixtures thereof and which is introduced at a rate of about 40 pounds per hour through first aeration means 50. A lift gas consisting of steam, carbon dioxide, or mixtures thereof is introduced through second aeration means 58 at a rate of about 2 pounds per hour to lift the heated char upwardly in annular riser 60 and thence to discharge the heated char downwardly in a downwardly flowing annular column along the inside diameter of conduit reactor 20. A turbulent stream of particulate coal and a transport gas are conveyed through first feed conduit 30 and discharged downwardly and centrally into conduit reactor 20 at a rate of about 300 pounds of coal per hour and about 50 pounds of transport gas per hour. The transport gas is the recycle pyrolysis gas which comprises hydrogen, carbon monoxide, carbon dioxide, steam, methane, and other light hydrocarbon gases.

The heated coal char, conveyed in second feed conduit 52 at a temperature of about 1300° F., is introduced into fluidization chamber 40. Heat is transferred from the downwardly flowing annular column of heated particulate char in conduit reactor 20 to the particulate coal. A stream comprising gaseous and vaporous products and newly-formed coal char product, as well as the spent heated char, the fluidizing, lift and transport gases, is removed through outlet 24 of conduit reactor 20. About 0.5 pounds of gaseous and vaporous product, and about 0.5 pounds of newly-formed coal char product are produced per pound of particulate coal.

After separation, the gases and vapors in stream 410 are sent to a product recovery section, not shown in the figures, wherein gases such as metane, CO, $CO_2$, and coal liquids are separated and recovered.

What is claimed is:

1. An apparatus operative for pyrolyzing coals comprising:

a. a conduit reactor having an inlet, an outlet, a circular cross-section of constant inside diameter over a predetermined distance from said inlet, the axis of said reactor being vertically oriented, and the plane of said inlet being perpendicular to said axis;

b. a first feed conduit operative for conveying a mixture which comprises a transport gas and particulate coal in turbulent flow, having an inlet and an outlet, having a circular cross-section and an axis which coincides with said reactor axis, the plane of said first feed conduit outlet being perpendicular to said axis and being in communication with said reactor inlet in such a way that the plane of said first feed conduit outlet is not above the plane of said reactor inlet, said reactor inside diameter being at least about three times the outside diameter of said first feed conduit outlet; and c. a fluidization chamber, operative for fluidizing a mixture of particulate solid heating media with a fluidizing gas, said chamber being in communication with said reactor inlet, which comprises i. a cylindrical outer shell having an inside diameter which is at least about two times the outside diameter of said reactor, ii. a top cover which is above the plane of said reactor inlet and which is fastened to the upper part of said shell, said first feed conduit passing through, and being fastened to, said top cover, iii. a bottom cover which is below the plane of said reactor inlet and which is fastened to the lower part of said shell, said reactor passing through, and being fastened to, said bottom cover, iv. a first fluidization means operative for fluidizing particulate solid heating media in said chamber, v. a second feed conduit having an outlet, said second feed conduit being operative for introducing a stream of particulate solid heating media into said chamber, said second feed conduit being radially displaced from said reactor and said second feed conduit outlet being below the plane of said reactor inlet, vi. an annular baffle means having an axis which coincides with said reactor axis, said baffle means having a side wall and a deflector, said side wall having an inside diameter which is greater than said reactor outside diameter, said side wall extending above and below the plane of said reactor inlet, said side wall and said reactor in combination forming an annular riser, said deflector being above the plane of said reactor inlet and extending from said side wall to a point slightly radially inwardly of said reactor inside diameter, and vii. a second fluidization means having a plurality of outlets which are located radially inwardly of said side wall and radially outwardly of said reactor outside diameter but entirely below the lower extremity of said annular baffle means, said second fluidization means being operative for introducing a lift gas upwardly into said annular riser, said baffle means and said second fluidization means in combination being operative, when in use, to cause particulate solid heating media which is fluidized in said chamber to flow under said side wall, to flow upwardly in said annular riser, then to be deflected downwardly at the top of said annular riser by said deflector, and then to be formed into a substantially continuous and substantially uniform downwardly flowing annular column of particulate solid heating media along said reactor inside diameter.

2. The apparatus of claim 1 wherein said side wall inside diameter is from about 1.01 to about 1.25 times said reactor outside diameter.

* * * * *